US006845765B1

(12) United States Patent
Allshouse et al.

(10) Patent No.: US 6,845,765 B1
(45) Date of Patent: Jan. 25, 2005

(54) ARCHERY QUIVER ASSEMBLY WITH VIBRATION DAMPENER

(75) Inventors: James R. Allshouse, Newburgh, IN (US); Andrew J. Zirkelbach, Evansville, IN (US)

(73) Assignee: SOP Services, Inc., Las Vegas, NV (US)

( * ) Notice: Subject to any disclaimer, the term of this patent is extended or adjusted under 35 U.S.C. 154(b) by 0 days.

(21) Appl. No.: 10/761,946

(22) Filed: Jan. 21, 2004

(51) Int. Cl.[7] ..... F41B 5/06; F41B 5/20
(52) U.S. Cl. ..... 124/86; 124/25.5; 124/89
(58) Field of Search ..... 124/25.5, 25.7, 124/86, 88, 89; 224/916

(56) References Cited

U.S. PATENT DOCUMENTS

| | | | | | |
|---|---|---|---|---|---|
| 4,556,042 | A | * | 12/1985 | Izuta | 124/89 |
| 4,685,438 | A | | 8/1987 | Larson | |
| 4,907,567 | A | | 3/1990 | Henrich | |
| 5,190,022 | A | * | 3/1993 | Larson | 124/25.7 |
| 5,265,584 | A | | 11/1993 | Judson et al. | |
| 5,452,703 | A | | 9/1995 | Batemann, III | |
| 5,566,665 | A | | 10/1996 | Stinson | |
| 5,595,168 | A | * | 1/1997 | Martin | 124/89 |
| 5,735,257 | A | | 4/1998 | Walk | |
| 5,775,314 | A | | 7/1998 | Michael et al. | |
| 5,937,843 | A | | 8/1999 | Troncoso | |
| 6,006,734 | A | | 12/1999 | Sodaro | |
| 6,076,514 | A | | 6/2000 | Adams, Jr. | |
| 6,085,736 | A | * | 7/2000 | Osterhues | 124/89 |
| 6,257,220 | B1 | | 7/2001 | McPherson et al. | |
| 6,283,109 | B1 | | 9/2001 | Wiseby et al. | |
| 6,298,842 | B1 | * | 10/2001 | Sims | 124/89 |
| 6,382,201 | B1 | * | 5/2002 | McPherson et al. | 124/89 |
| 6,543,432 | B2 | | 4/2003 | Andrews et al. | |
| 6,712,059 | B2 | * | 3/2004 | Donovan | 124/89 |

* cited by examiner

*Primary Examiner*—John A. Ricci
(74) *Attorney, Agent, or Firm*—Woodard, Emhardt, Moriarty, McNett & Henry LLP

(57) ABSTRACT

Preferred embodiments of the present invention provide a quiver assembly, bow and method for dampening vibrations. Quiver assemblies useable with the present invention are often of conventional types mounted to various types of archery bows to hold one or more arrows in a convenient, portable location for the archer. These quiver assemblies can be used with various types of compound or recurve bows conventionally known in the industry. In a preferred feature, the present assembly provides one or more dampeners for reducing vibrations imparted to the quiver assembly and the overall bow construct. In a preferred embodiment, one or more dampeners are associated with the frame of the quiver assembly, and preferably are in floating engagement with the frame.

39 Claims, 7 Drawing Sheets

ARCHERY QUIVER ASSEMBLY WITH VIBRATION DAMPENER

FIELD OF THE INVENTION.

In certain preferred embodiments, the present invention deals with archery equipment, and in particular deals with a vibration dampening mechanism and method for dampening vibrations in an arrow quiver assembly.

BACKGROUND OF THE PRESENT INVENTION

When using archery bows of various types, a release of the bowstring and the accompanying arrow typically imparts significant vibration to the frame of the bow, as the stored energy in the bow limbs is released. These vibrations are transmitted throughout the bow and attached accessories and to the archer. It is preferable that these vibrations be quickly dampened to reduce stresses internally on the bow and related equipment and to reduce the stress on the body of the archer holding the bow. It is also preferable that vibrations be dampened quickly to reduce the noise created by the release of the bow, particularly in hunting situations.

Several dampening methods have been applied to the body of certain bows in attempts to reduce vibrations; however, attached accessories such as a quiver are frequently ignored. Preferred embodiments of the present invention provide improved dampening characteristics for certain accessories such as an archery quiver and contribute to overall dampening within the bow.

SUMMARY OF THE INVENTION

Preferred embodiments of the present invention provide a quiver assembly, bow and method for dampening vibrations. Quiver assemblies useable with the present invention are often of conventional types mounted to various types of archery bows to hold one or more arrows in a convenient, portable location for the archer. These quiver assemblies can be used with various types of compound or recurve bows conventionally known in the industry. In a preferred feature, the present assembly provides one or more dampeners for reducing vibrations imparted to the quiver assembly and the overall bow construct. In a preferred embodiment, one or more dampeners are associated with the frame of the quiver assembly, and preferably are in floating engagement with the frame.

In one preferred embodiment, the present invention involves a quiver assembly comprising a frame of a quiver assembly for an archery bow and at least one dampener made of a vibration dampening material in floating association with the frame and arranged to dampen vibrations imparted to the frame.

In a further preferred embodiment, a quiver assembly includes a frame of a quiver assembly for an archery bow, having at least a portion defining opposing sides and defining at least one communication port between the opposing sides through the frame. A first dampener is arranged on one side of the communication port to contact the frame to dampen vibrations imparted to the frame. A second dampener is arranged on the opposing side of the communication port to contact the frame to dampen vibrations imparted to the frame. Preferably the first dampener is coupled to the second dampener through the communication port and the dampeners are not connected to the frame.

In a still further embodiment, the present invention involves a quiver assembly comprising a frame and a clip disposed on the frame for receiving the shafts of one or more arrows. A hood is disposed on the frame for receiving the heads of one or more arrows and the frame is mounted to an archery bow using a bracket, while at least one dampener of a vibration dampening material is in floating association with the frame and is arranged to dampen vibrations imparted to the frame.

In an alternate embodiment, the present invention involves a quiver assembly comprising a frame. A clip and a hood are disposed on the frame for receiving one or more arrows. The frame is mounted to an archery bow using a bracket and a pair of dampeners are coupled through a communication port defined in the frame and are arranged to dampen vibrations imparted to the frame.

It is an object of the present invention to provide an improved archery quiver assembly and method.

DESCRIPTION OF PREFERRED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Preferred embodiments of the present invention provide a quiver assembly, bow and method for dampening vibrations. Quiver assemblies useable with the present invention are often of conventional types mounted to various types of archery bows to hold one or more arrows in a convenient, portable location for the archer. These quiver assemblies can be used with various types of compound or recurve bows conventionally known in the industry. In a preferred feature, the present assembly provides one or more dampeners for reducing vibrations imparted to the quiver assembly and the overall bow construct. In a preferred embodiment, one or more dampeners are associated with the frame of the quiver assembly, and preferably are in floating engagement with the frame.

Figure 1A:
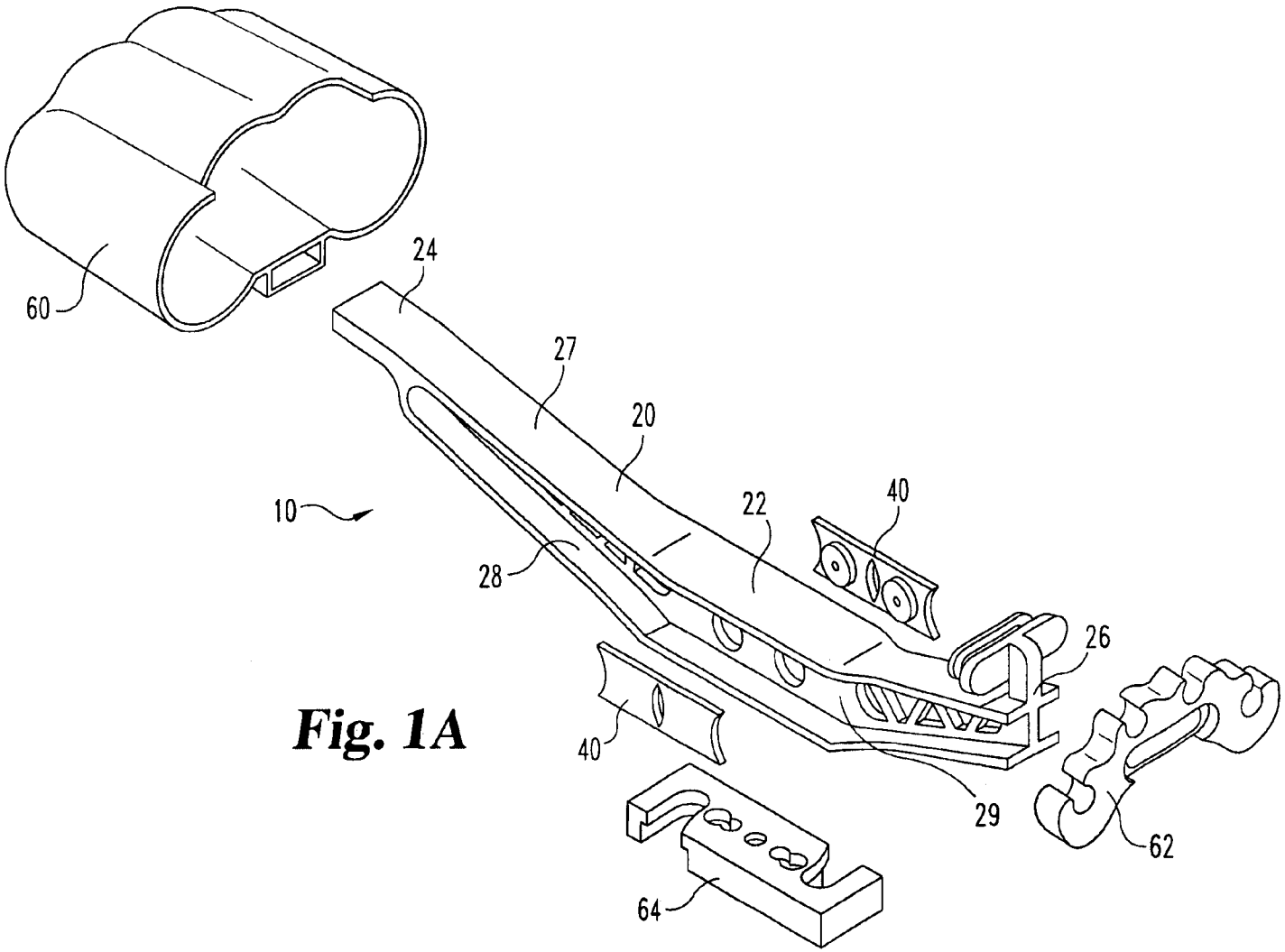
FIG. 1A is an exploded view of an archery quiver assembly according to one preferred embodiment of the present invention.
Figure 1B:
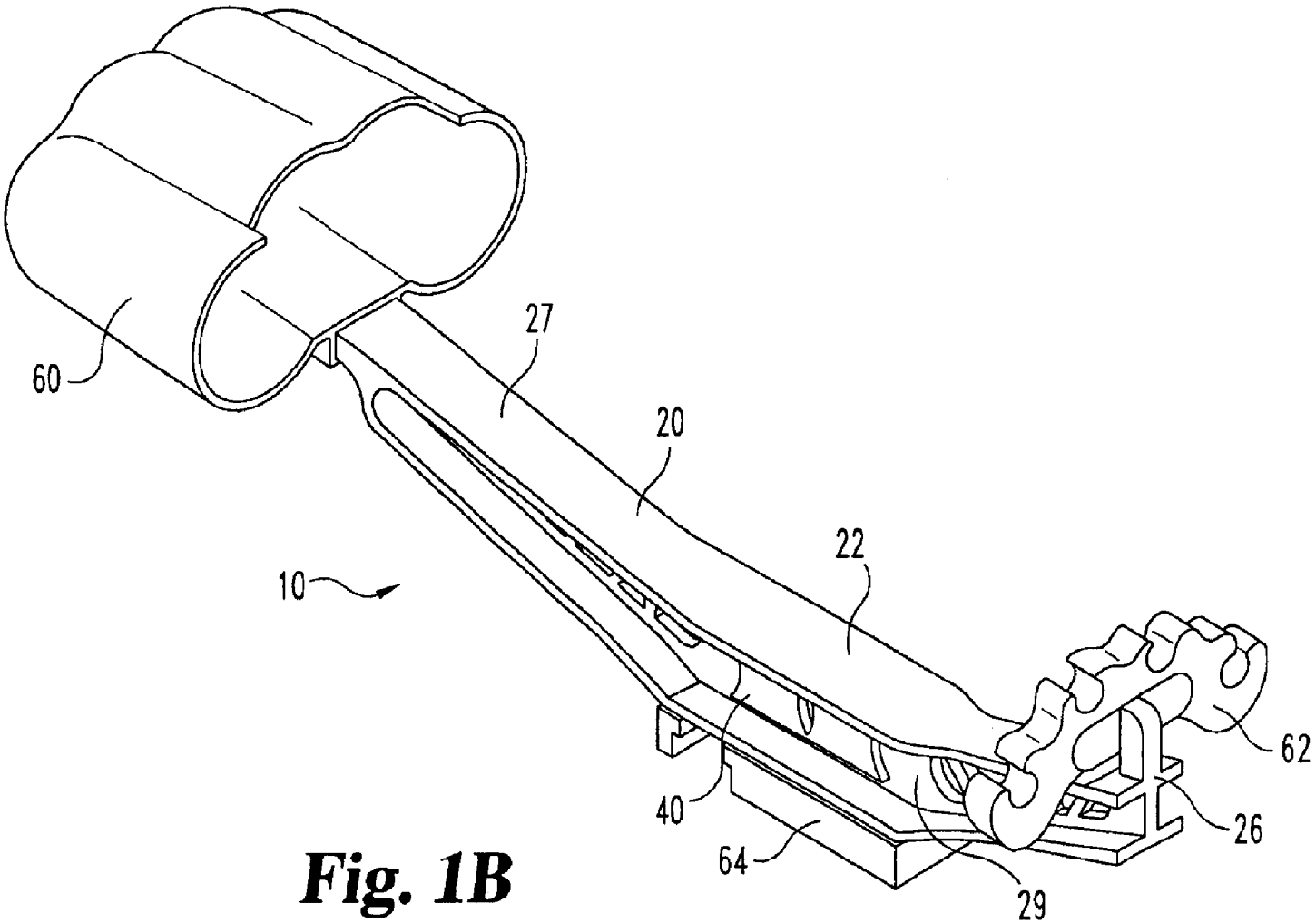
FIG. 1B is an assembled perspective view of the archery quiver assembly of-FIG. 1A.

FIGS. 1A and 1B illustrate one example of a preferred embodiment of a quiver assembly according to the present invention. Quiver assembly 10 preferably includes a frame 20 extending longitudinally along the length of the quiver assembly and mountable to an archery bow. Quiver frame 20 preferably has a central portion 22, a hood end 24 mountable to a hood 60, and a clip end 26 mountable to a clip 62. Clip 62 and hood 60 cooperate to mount one or more arrows to the quiver assembly when in use. Preferably the hood 60 receives the points of the arrows to protect them from being tangled and preventing the archer from accidentally being injured. Preferably clip 62 receives the arrow shafts.

In the embodiment shown, frame 20 preferably has a front plate 27 and a parallel rear plate 28 separated by an upright plate 29. Directional references herein are provided for context and clarity, but do not indicate any absolute direction. Preferably the plates extend substantially the length of frame 20. Front plate 27, rear plate 28 and upright plate 29 preferably define one or more channels 30 along all or a portion of the length of frame 20. Channels 30 preferably have a "C" or sideways "U" cross-section having a top, bottom and side, substantially at right angles, and having an open outward face. In the embodiment shown, frame 20 has an I-beam style cross-section with two channels 30. Upright plate 29 defines opposing sides of the frame, and optionally is formed with an open truss structure having cut out openings 38 to retain strength while reducing the overall weight and mass of the quiver assembly. In one embodiment, bracket 64 provides an interface between bracket posts 39 of frame 20 and a bow in order to mount the quiver assembly 10 to the bow. Other usable mounting methods are well known.

Figure 2:
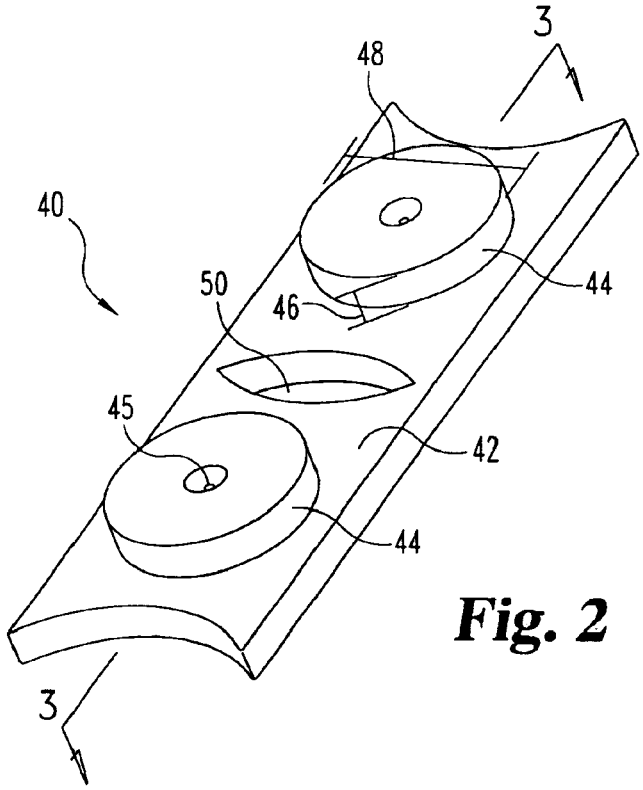
FIG. 2: is a perspective view of a dampener member used in certain preferred embodiments of the present invention.
Figure 3:
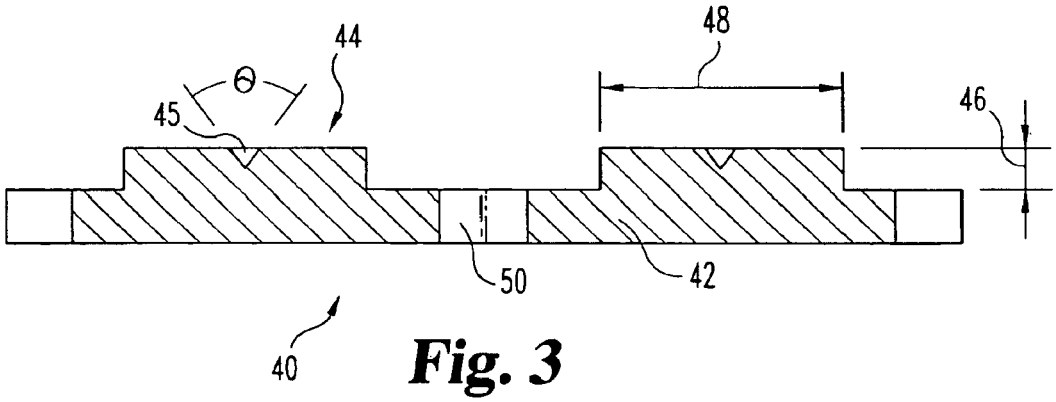
FIG. 3 is a sectional view of the dampener member of FIG. 2 taken along line 3—3.

A dampener 40, preferably mountable to central section 22 of frame 20, is illustrated with a perspective view in FIG. 2 and a cross-sectional view along line 3—3 in FIG. 3. In a preferred embodiment, dampener 40 includes a base portion 42 and one or more tabs or insert portions 44 extending from base 42. Base portion 42 has a front face portion, side and end portions and a rear face, each with surface area portions.

As illustrated, tabs or insert portions 44 have a circular cross-section with a diameter or width 48, height 46 and form cylindrical pieces. In one preferred feature, tabs 44 define a glue pocket 45 in each tab to receive a portion of adhesive. In one preferred embodiment, glue pockets 45 are formed in an inverted conical shape spanning an angle θ, for example 90°, between the walls of the cone. In certain preferred options, dampener 40 may include openings 50 and arcuate end portions for ease of manufacture, mounting and to control the strength and vibration dampening aspects of dampener 40.

Figure 4:
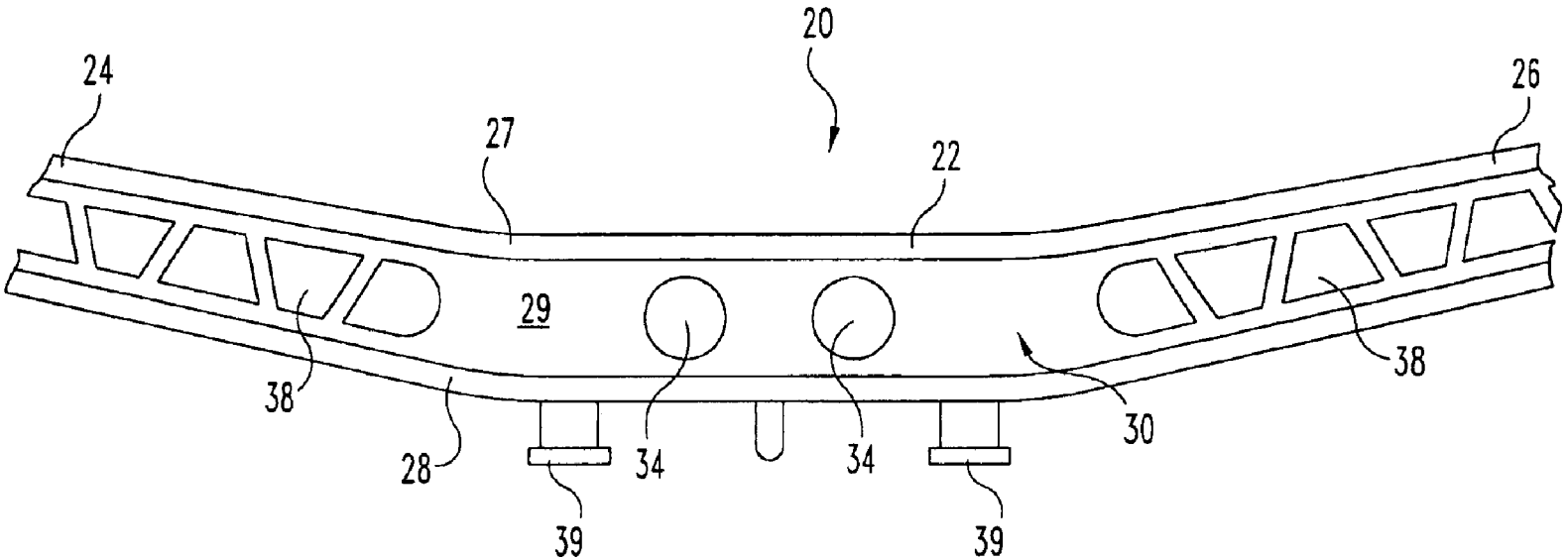
FIG. 4 is a side view of a portion of an archery quiver assembly frame.

Preferably, at least one dampener is arranged to dampen vibrations imparted to the frame. Illustrated in FIG. 4 is a side view of central portion 22 of frame 20. Frame 20 includes top plate 27, bottom plate 28 and upright plate 29 creating a channel 30 with a width between the top plate and bottom plate. Preferably in the central portion, one or more communication ports 34 are formed in upright plate 29. Communication ports 34 are illustrated with a circular cross-section corresponding to tab width 48 to receive tabs 44 of dampener 40; however, various shapes and geometries may be used as desired. Preferably frame 20 includes at least one communication port 34, two ports 34 are illustrated in a preferred embodiment, and more ports may be used as desired.

Figure 5A:
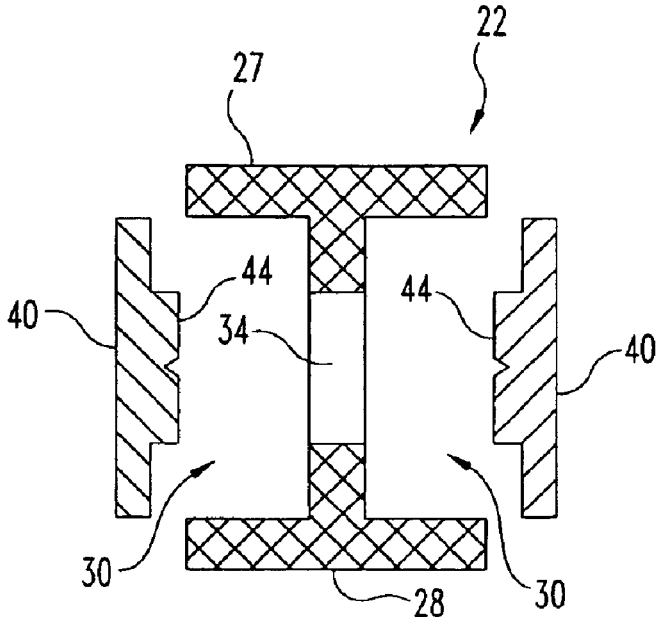
FIGS. 5A and 5B are exploded and assembled cross-sectional views of a quiver assembly frame and dampener members according to a preferred embodiment of the present invention.
Figure 5B:
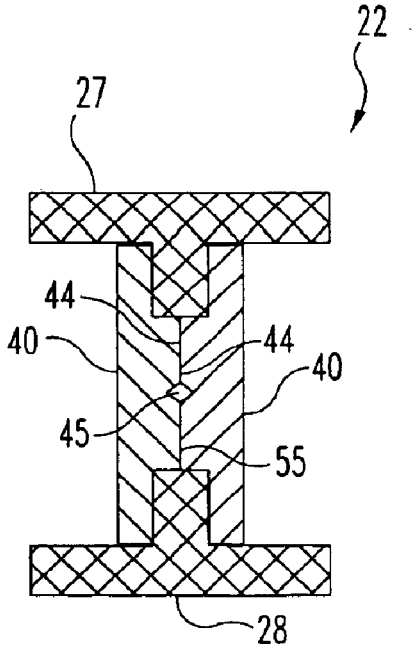

A method of assembling a pair of dampeners 40 to the frame is illustrated in FIGS. 5A and 5B. A cross-section of frame central portion 22 is illustrated with top plate 27, bottom plate 28 and an upright plate with a port 34. As illustrated, two dampeners 40 are advanced into channels 30 on opposing sides of the upright plate so that the protrusions or tabs 44 are inserted into a port 34. Preferably each tab 44 extends at least partially through opening 34 so that the pair of dampeners 40 meet and form a join 55 between them. Preferably during assembly, a portion of adhesive is placed in the glue pocket 45 of one or both dampeners and adheres to form a bond where the dampeners contact each other along join 55. Preferably the adhesive seals the pair of dampeners to each other, but does not adhere to the portions of frame 20. Glue or adhesive is a preferred method of bonding the dampeners; however, other chemical or mechanical bonding methods may be used, for example a heat seal, chemical bond or various mechanical connectors.

In a further alternate embodiment, at least one of the dampeners does not have an insert portion which enters port 34, and the join location is at an edge or external to port 34. For example, one dampener may have one or more tabs with a height extending completely through one or more ports, and a second dampener is formed with a flat base portion which contacts the tabs. In an alternate example, two dampeners are used on opposing sides of plate 29 and one or more connectors extend between the dampeners. Connectors can be of the same material as the dampeners, or different materials. Examples of mechanical connectors include screws, bolts and rivets. Still further, a tab can be separate and sized to contact and be adhered to a flat surface of one or two dampeners, or to extend partially or completely through a receiving port in the dampener, similar to a plug or cork.

In the embodiment illustrated in FIG. 1, dampeners 40 are preferably in "floating association" with frame 20. "Floating association" is intended to include contact between the dampener and the frame along one or more surface areas of the dampener, without a fixed connection directly between the frame and the dampener. In an alternate characterization, the dampener is touching the frame portion, optionally with frictional engagement, but could be subject to relative movement. The dampener may be held in place due to its geometry, but it is not glued, welded, or connected directly to the frame with a fastener. Not all embodiments described herein use floating association.

In the embodiment shown in FIG. 1, the pair of dampeners 40 are engaged and associated with frame portion 22 such that after bonding or joining of tabs 44, dampeners 40 are retained from removal due to the geometry of opening 34 and base portions 42. However, the pair of dampeners is able to float, within limits, relative to the frame. In an alternate, less preferred embodiment, a fastener may connect two dampeners 40 to each other in order to hold join 55 together, with the dampeners in floating engagement to the frame.

In a less preferred embodiment, one or more of the dampeners is not in floating association and is directly affixed to the frame. The dampener may be affixed across all or portions of various surface areas and faces of the dampener.

In the embodiments shown in FIGS. 2–3 and 5A and 5B, base portion 42 preferably has a width substantially filling the width of channel 30 in the frame. The dampener 40 includes a face portion of the base 42 with a surface area having at least portions contacting upright plate 29. In certain embodiments, the top and bottom sides of dampener 40 include surface area portions which contact the top and bottom plates respectively of the frame. Preferably dampener 40 is sized for a snug fit between the base portion 42 and the channel 30 and between tabs 44 and openings 34.

Preferably a frictional or a snug fit between the portions assists in transferring vibration energy from the frame to the dampening member and also assists in maintaining the dampener members in place.

In various embodiments, one or more dampeners or pairs of dampening members may be used as desired. Similarly, one or more openings 34 along frame 20 may be defined in the frame for interaction between the frame and one or more dampeners or pairs of dampeners. In the embodiment illustrated, a pair of dampeners 40 are mounted in central portion 22 of frame 20 adjacent bracket 64 at the closest approach point to the bow structure; however, one or more dampeners 40 can be mounted at various locations along the length of the frame as desired.

For example, quiver assembly 10 includes components made of conventional materials such as frame 20, hood 60 and bracket 64 which are made of high impact ABS plastic. Clip 62 may be made of a semi-resilient material to hold standard arrows, such as aluminum arrows or composite arrows. For example, the clip may be made from a PVC homopolyester resin. Other conventional materials may be used.

Preferably vibration dampeners used with the present assembly are formed from a material different from the frame material and/or suitable to receive vibrations imparted to the quiver assembly and to dampen the vibrations carried through the assembly and interacting with the dampeners. Various rubber, polymer, silicon and urethane based materials of various densities are known for this purpose. In one preferred embodiment the dampener is formed from a PVC homopolyester resin with an 85-durometer hardness. A preferred hardness range is 55 to 85 durometer.

Figure 6A:
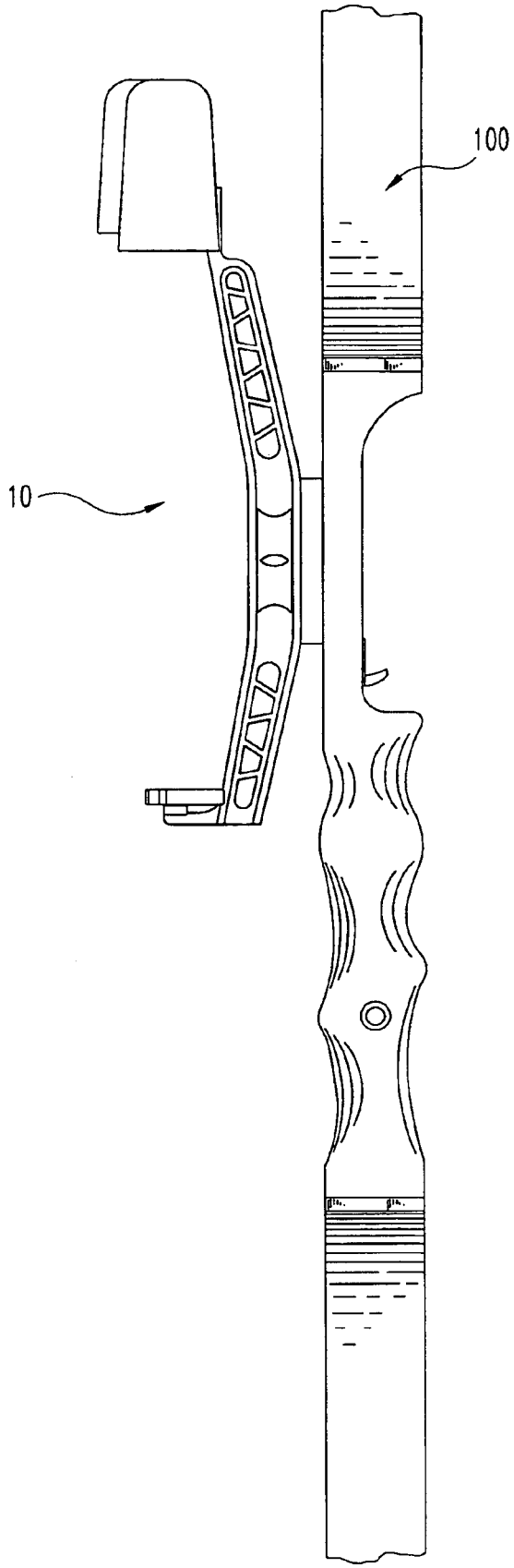
FIGS. 6A and 6B are front and side views of an archery bow with a quiver assembly according to certain preferred embodiments of the present invention.
Figure 6B:
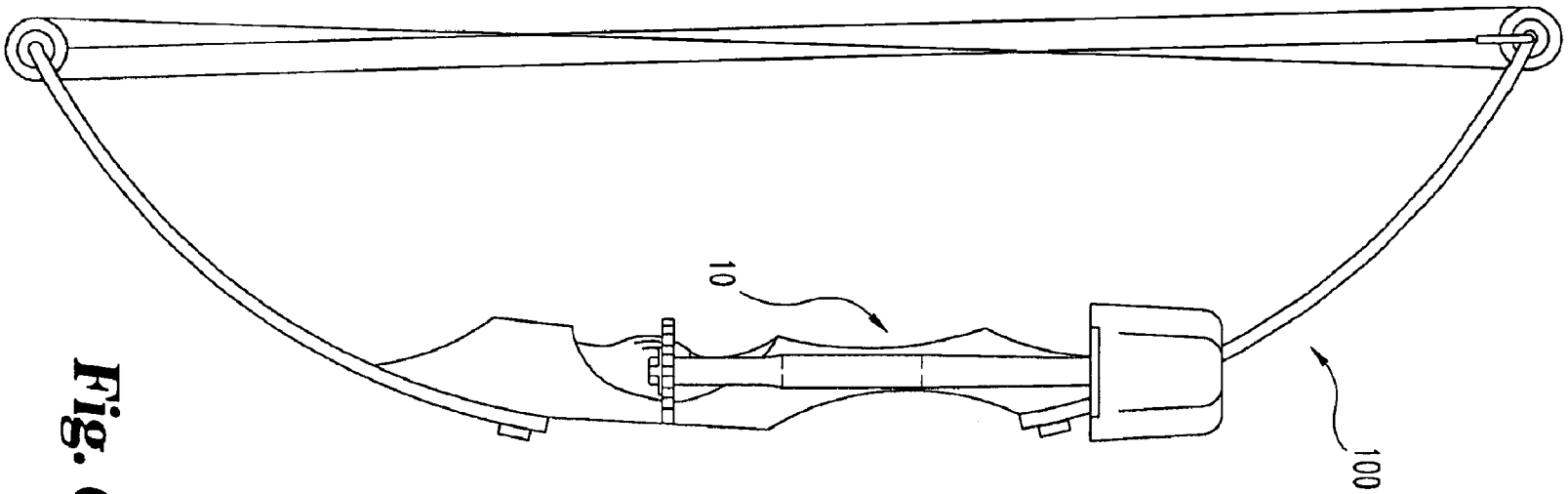

Illustrated in FIGS. 6A and 6B are front and side perspectives of a bow 100 mounted with quiver assembly 10. Bow 100 is illustrated as a compound bow with a conventional riser, bow limbs, pulleys and a bow-string/cable, although it will be understood that various types of bows may be used. In the embodiment illustrated, quiver 10 is preferably mounted vertically in relation to the bow with hood 60 upwardly oriented to the bow, and with the quiver assembly mounted on the opposing side of the riser from the arrow rest. In this arrangement, the arrow points are typically received within hood 60 and the shafts are held by clip 62 with the fletchings downward.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An assembly, comprising:

a frame of a quiver assembly for an archery bow; and, at least one dampener made of a vibration dampening material in floating association with said frame and arranged to dampen vibrations imparted to said frame, wherein said frame defines a channel and wherein said dampener is arranged in said channel.

2. The assembly of claim 1, wherein said frame defines two opposing side, and wherein said frame defines one or more communication ports between said opposing sides.

3. The assembly of claim 2, comprising as least two dampeners in floating association with said frame, with at least one dampener arranged on each opposing side of said frame, with said dampeners connected to each other through at least one communication port.

4. The assembly of claim 2, wherein said opposing sides are in opposing channels defined in said frame.

5. The assembly of claim 4, wherein at least one of said dampeners has a width to substantially fill the width of one of said channels.

6. The assembly of claim 1, wherein said at least one dampener has at least one face portion with a surface area contacting said frame.

7. The assembly of claim 6, wherein said at least one dampener is received in a channel defined in said frame, wherein said dampener has a face portion with a surface area contacting said channel and at least two side portions with surface areas contacting said channel.

8. The assembly of claim 1, comprising at least a pair of dampeners in floating association with said frame, wherein each dampener has at least one face portion with a surface area contacting said frame, and wherein said dampeners are connected to each other through at least one communication port defined in said frame.

9. The assembly of claim 8, wherein said at least one pair of dampeners are received in a opposing channels defined in said frame, such that each said dampener has at least two side portions with surface areas contacting the frame.

10. The assembly of claim 9, comprising a bow mounted to said frame.

11. An assembly, comprising:

a frame of a quiver assembly for an archery bow; and, at least two dampeners made of a vibration dampening material in floating association with said frame and arranged to dampen vibrations imparted to said frame, wherein said dampeners are connected to each other through at least two communication ports defined in said frame.

12. The assembly of claim 1, wherein said at least two dampeners are connected with adhesive.

13. A quiver assembly, comprising:

a. a frame of a quiver assembly for an archery bow, having at least a portion defining opposing sides and defining at least one communication port between said opposing sides through said frame, b. a first dampener arranged on one side of said communication port and contacting said frame to dampen vibrations imparted to said frame;

c. a second dampener arranged on the opposing side of said communication port and contacting said frame to dampen vibrations imparted to said frame;

d. wherein said first dampener is coupled to said second dampener through said communication port and wherein said dampeners are not connected to said frame; and, wherein said first dampener abuts said second dampener.

14. The quiver assembly of claim 13, wherein at least a portion of one of said first dampener and said second dampener extends at least partially through said communication port.

15. The quiver assembly of claim 14, wherein a portion of said first dampener extends at least partially through said communication port to contact a portion of said second dampener extending at least partially through said communication port.

16. The quiver assembly of claim 15, wherein said first dampener is adhered to said second dampener.

17. The quiver assembly of claim 16, wherein said first dampener is adhered to said second dampener with adhesive disposed in at least one glue pocket defined in at least one of said dampeners.

18. A quiver assembly, comprising:

a. a frame;

b. a clip disposed on said frame for receiving the shafts of one or more arrows;

c. a hood disposed on said frame for receiving the heads of one or more arrows;

d. a bracket for mounting said frame to an archery bow; and, e. at least a pair of dampeners in floating association with said frame and coupled through at least one communication port defined in said frame wherein said dampeners are in an abutting arrangement.

19. The quiver assembly of claim 18, wherein said frame includes a parallel top plate and a bottom plate, with a cross-plate between said top plate and said bottom plate, and with said at least one communication port defined in said cross-plate.

20. The quiver assembly of claim 19, wherein said dampeners each comprise an insert portion engaged with said communication port.

21. The quiver assembly of claim 20, wherein each said insert portion has a round cross-section.

22. The quiver assembly of claim 20, wherein said insert portions are frictionally engaged with said communication port.

23. The quiver assembly of claim 20, wherein said insert portions are aligned to form a joint between said dampeners.

24. The quiver assembly of claim 23, wherein said insert portions are attached to each other with adhesive.

25. The quiver assembly of claim 24, wherein said insert portions define at least one glue pocket at said joint.

26. The quiver assembly of claim 18, wherein at least one of said dampeners includes a base with multiple sides, each side having at least one surface area portion, wherein two or more surface area portions are in contact with said frame.

27. The quiver assembly of claim 26, wherein said frame defines at least one channel between a top plate and a bottom plate and wherein said at least one dampener is in said channel.

28. The quiver assembly of claim 27, wherein at least one surface area portion contacts said top plate and wherein at least one surface area portion contacts said bottom plate.

29. The quiver assembly of claim 27, wherein said dampener has a width substantially filling the width of said channel.

30. A quiver assembly, comprising:

a. a frame;

b. a clip disposed on said frame for receiving the shafts of one or more arrows;

c. a hood disposed on said frame for receiving the heads of one or more arrows;

d. a bracket for mounting said frame to an archery bow; and, e. a pair of dampeners abuttingly coupled through a communication port defined in said frame and arranged to dampen vibrations imparted to said frame.

31. The quiver assembly of claim 30, wherein said dampeners are arranged in opposing channels defined in said frame.

32. The quiver assembly of claim 30, wherein each dampener has at least one face portion with a surface area contacting said frame.

33. The quiver assembly of claim 30, wherein each dampener has a face portion with a surface area contacting said frame and at least two side portions with surface areas contacting said frame.

34. A method of dampening vibrations imparted to a quiver assembly, comprising the steps of:

a. providing a frame defining opposing side;

b. connecting a first dampener on one side of said frame to a second dampener on the opposing side of said frame through a communication port in said frame, wherein said first dampener abuts said second dampener.

35. The method of claim 34, further comprising the step of advancing a portion of at least partially into the communication port in said frame.

36. The method of claim 34 further comprising the step of adhering said first dampener to said second dampener.

37. The method of claim 34 further comprising the step of connecting said first dampener to said second dampener with a mechanical connector.

38. The method of claim 34, wherein said first dampener and second dampener are in floating association with said frame.

39. The method of claim 38, comprising mounting said frame to a bow.

* * * * *

UNITED STATES PATENT AND TRADEMARK OFFICE

CERTIFICATE OF CORRECTION

PATENT NO. : 6,845,765 B1
DATED : January 25, 2005
INVENTOR(S) : James R. Allshouse and Andrew J. Zirkelbach It is certified that error appears in the above-identified patent and that said Letters Patent is hereby corrected as shown below:

Column 6,
Line 34, replace "1" with -- 11 --.

Signed and Sealed this

Nineteenth Day of April, 2005

JON W. DUDAS
*Director of the United States Patent and Trademark Office*